US005458377A

United States Patent [19]

Utz et al.

[11] Patent Number: 5,458,377

[45] Date of Patent: Oct. 17, 1995

[54] INFORMATION RETRIEVAL DEVICE

[76] Inventors: John S. Utz, 604/26 Ridge Street, North Sydney, N.S.W. 2060; David A. Nickoll, 6/22 Fisher Road, Wee Why, N.S.W. 2099, both of Australia

[21] Appl. No.: 256,824

[22] PCT Filed: Dec. 1, 1993

[86] PCT No.: PCT/AU93/00612

§ 371 Date: Jul. 25, 1994

§ 102(e) Date: Jul. 25, 1994

[87] PCT Pub. No.: WO94/12967

PCT Pub. Date: Jun. 9, 1994

[30] Foreign Application Priority Data

Dec. 2, 1992 [AU] Australia ..... 29849/92

[51] Int. Cl.[6] ..... B42D 15/00

[52] U.S. Cl. ..... 283/65

[58] Field of Search ..... 283/65, 116, 115, 283/48.1; 462/64, 65; 281/45, 38

[56] References Cited

U.S. PATENT DOCUMENTS

| | | | |
|---|---|---|---|
| 4,431,214 | 2/1984 | Buffington | 283/65 X |
| 4,913,694 | 4/1990 | Alphenaar et al. | 283/65 X |
| 5,112,290 | 5/1992 | Hibsch | 283/65 X |
| 5,137,302 | 8/1992 | Angel | 283/65 |

*Primary Examiner*—Willmon Fridie
*Attorney, Agent, or Firm*—Edwin D. Schindler

[57] ABSTRACT

This invention relates to a device to facilitate the retrieval of stored information. More particularly it relates to a device which has a form allowing economic manufacture and captivation of an element of the device, which needs to move to make the device operational, until the device is about to be first put into service.

8 Claims, 4 Drawing Sheets

INFORMATION RETRIEVAL DEVICE

Figure 1:
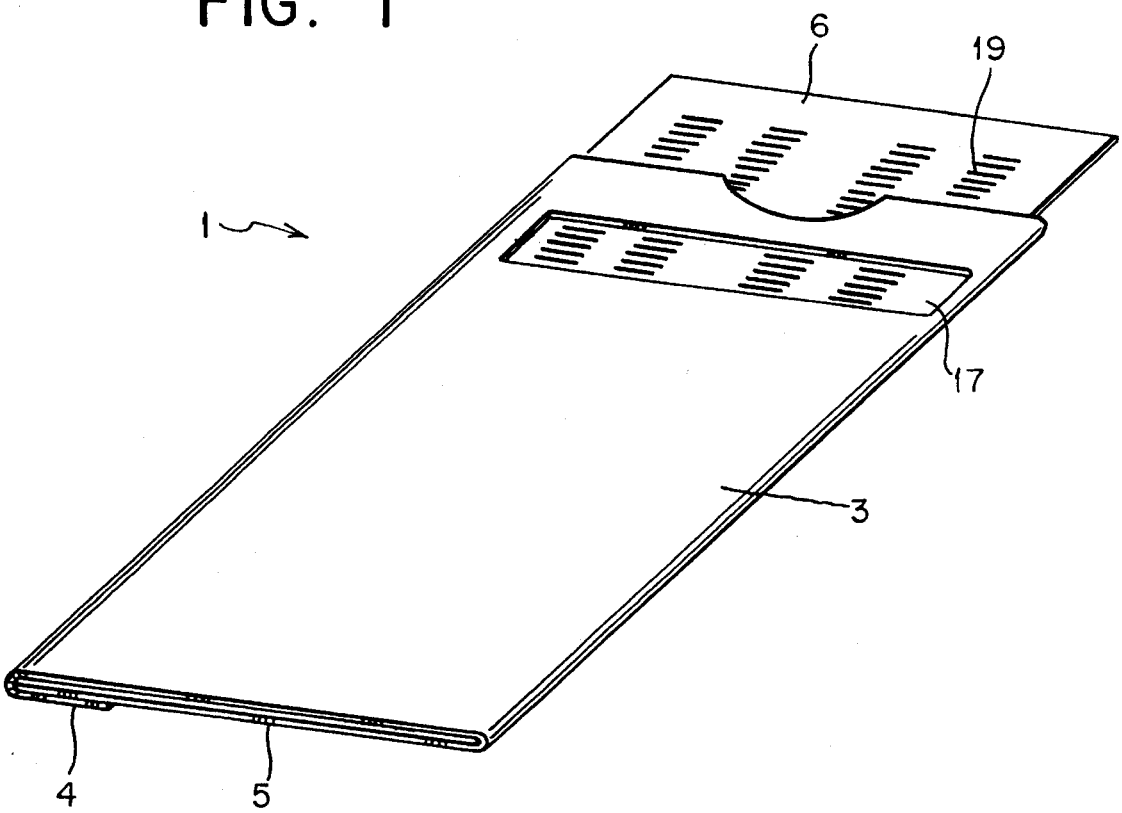

This invention relates to a device to facilitate the retrieval of stored information. More particularly it relates to a device .which has a form allowing economic manufacture and captivation of an element of the device, which needs to move to make the device operational, until the device is about to be first put into service.

The storage and retrieval of information on related matters is an ongoing requirement in modern society. For example persons needing information relating dates of sporting fixtures and locations thereof, or conversions from one currency to another or from one system of measurement to another do not want to consult books or other bulky items and there is therefore a need for a more readily accessible information source.

A device of known type where an information bearing slider panel is slid within a sleeve having a viewing aperture or apertures to allow related information on the slider panel to be seen has been widely used for the above purposes. Such devices can be made in convenient sizes that are readily housed in a wallet or the like.

The possibility of using such devices as an advertising item of the give away type has been considered but the cost of the device as commonly manufactured mitigates against such use. The conventional methods of manufacturing such devices known to the inventors involve a large labor component with a corresponding manufacture cost. It is the object of this invention to provide an extremely low cost item by mechanizing the production of the device.

Broadly stated the invention provides an information retrieval device including a sleeve with a viewing aperture and an information slide panel in the sleeve where the slider panel is retained in the sleeve by a frangible connecting means until the device is to be used. The first force applied to the slider panel to move it in the sleeve destroys the frangible connection and the device can thereafter operate normally. The manufacture of the device of the above form is fully mechanical thereby eliminating the manual labor component required hitherto to fabricate such devices.

The present invention, more specifically, provides an information retrieval device including an open ended circumferentially closed sleeve with at least one aperture in said sleeve to give viewing access to an information bearing slider panel portion mounted in the sleeve and retained therein by frangible connection means, said connection means being adapted to be broken by a force applied to said slider panel portion to slide it within said sleeve.

A method of making an information card as above is also disclosed herein where the method includes the steps of providing a sheet of stiff material, forming parallel fold lines along said sheet to provide a front panel portion disposed between a back panel portion of substantially the same width as the front panel portion and a narrower glue panel portion and a further parallel fold line along said sheet which is perforated to provide a frangible connection means between said back panel portion and a slider panel portion, providing at least one viewing aperture in at least one of the front and back panel portions, followed by fabrication steps including forming a fold along said perforated fold line to place said slider panel portion in overlying relationship with an inner face of said back panel portion, forming a fold along the fold line between said front panel portion and said back panel portion to place the front and back panel portions in overlying relationship with said slider panel portion sandwiched therebetween, forming a fold along the fold line between said front panel portion and said glue panel portion to place said glue panel portion in an overlying relationship with part of an outer face of said back panel portion and gluing said glue panel portion to said back panel portion.

Figure 2:
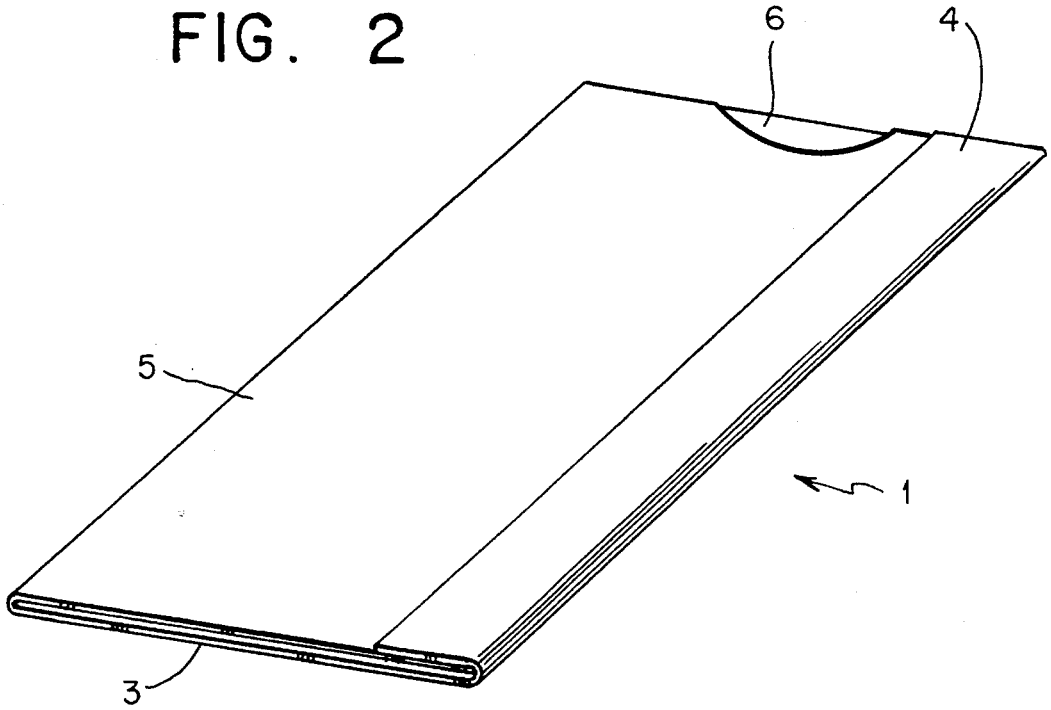
Figure 3:
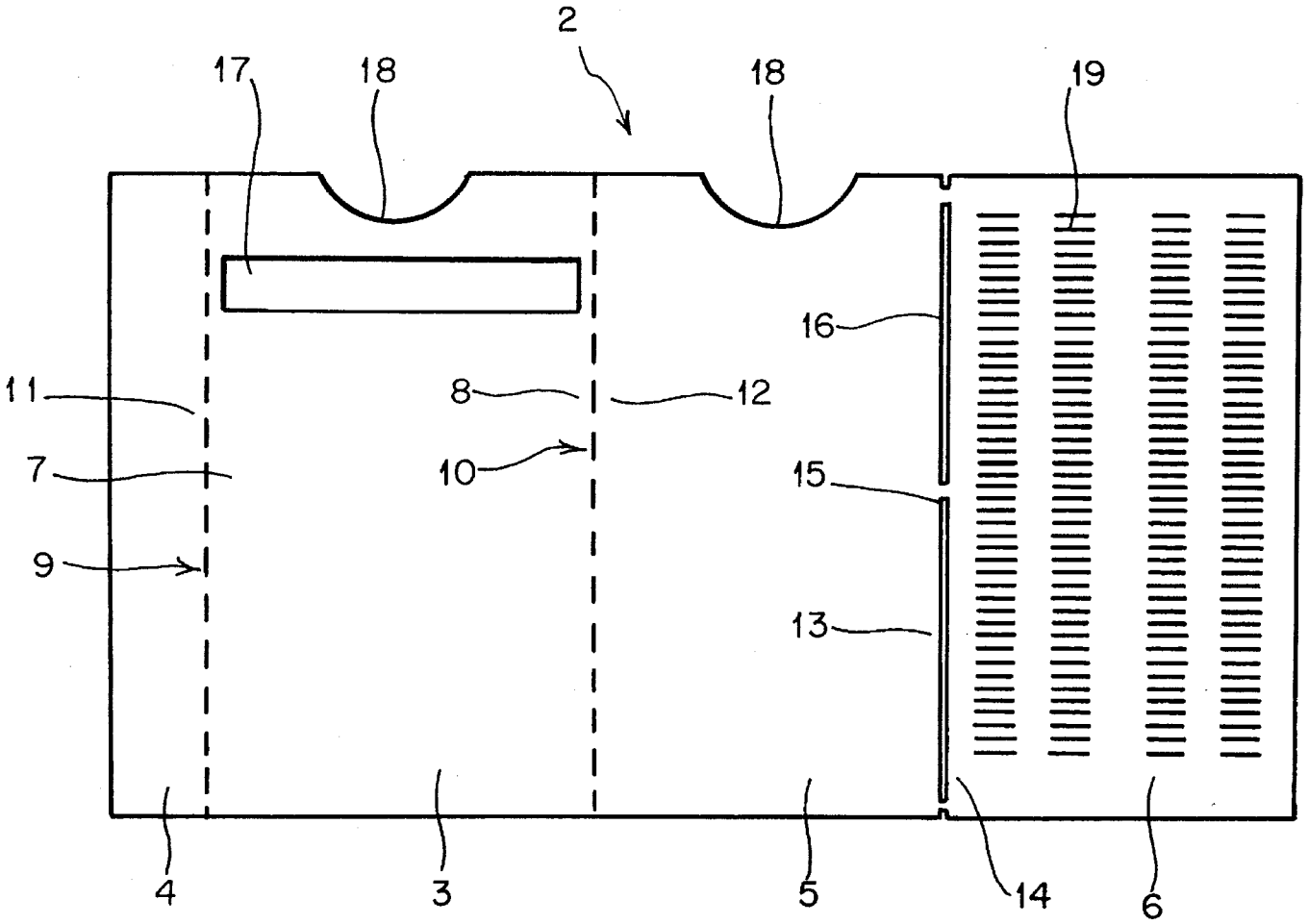
Figure 4:
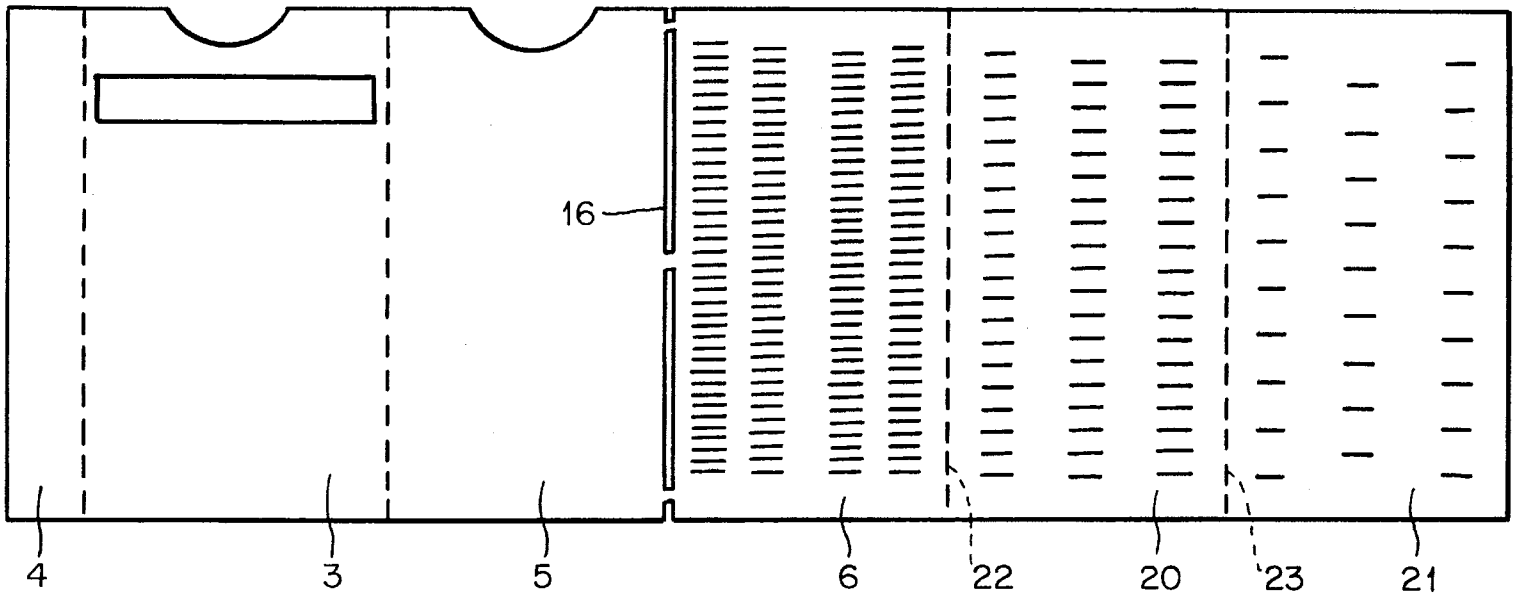
Figure 5:
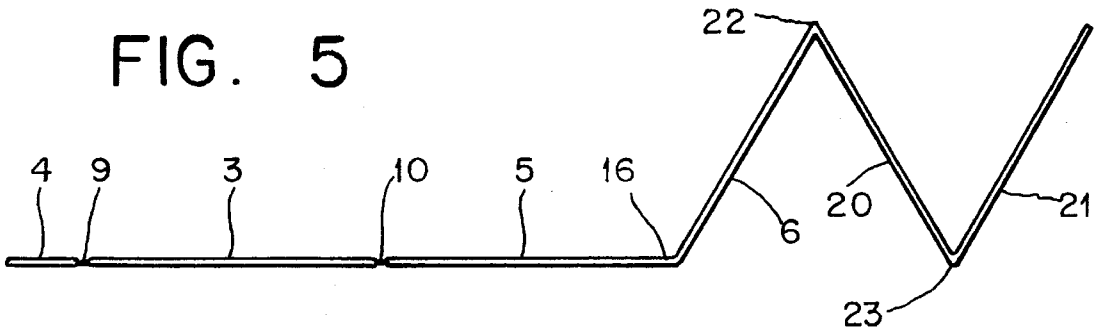
Figure 6:
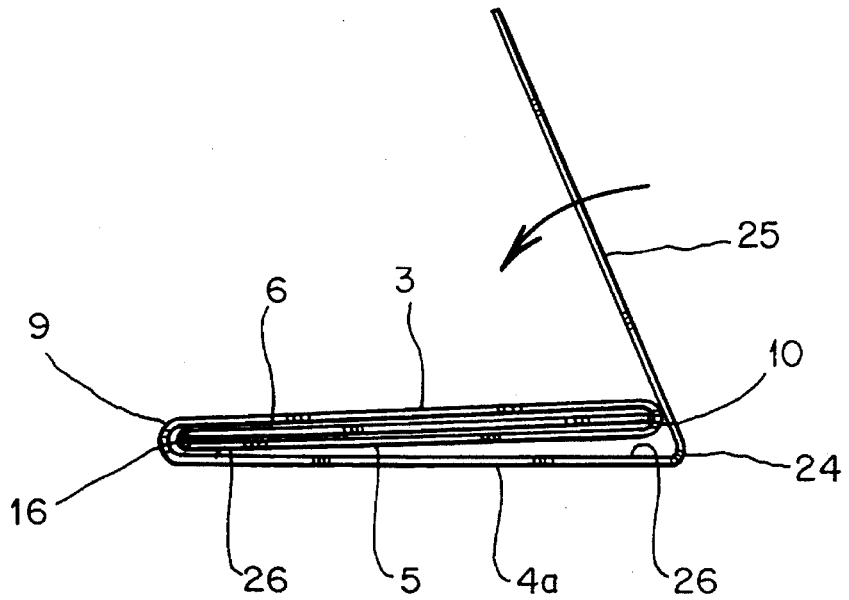
Figure 7:
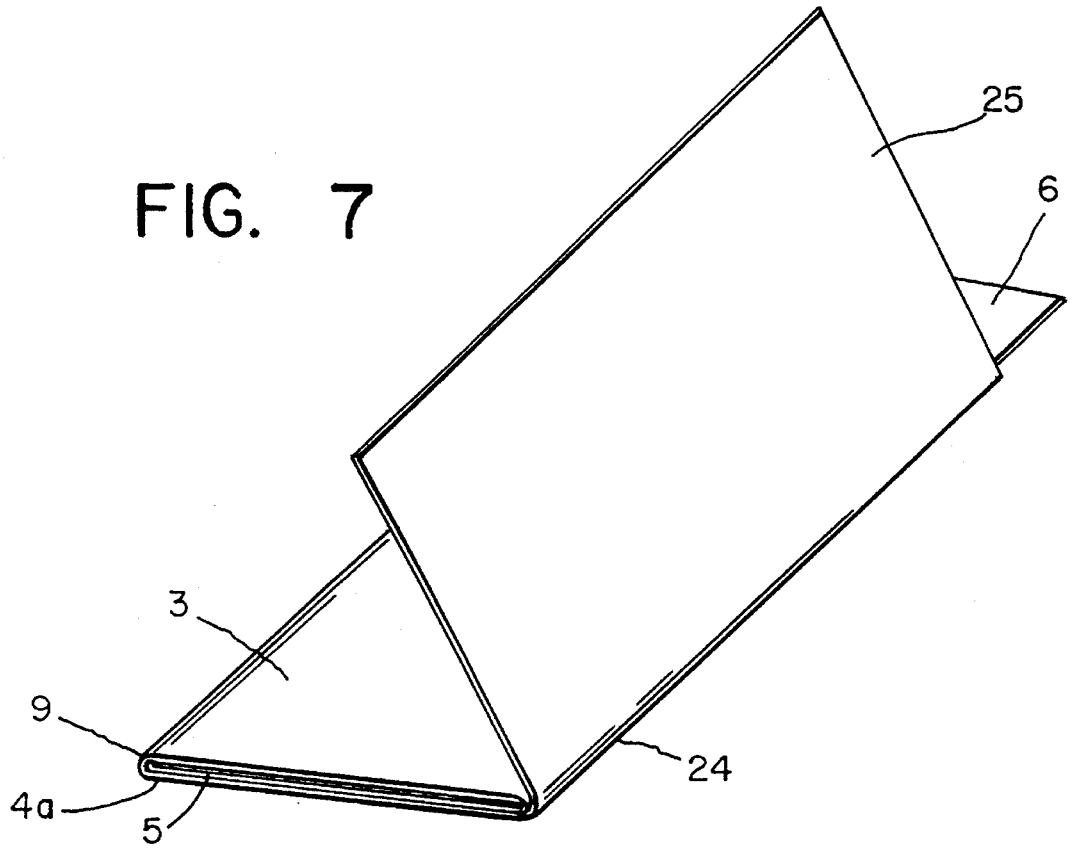

A presently preferred embodiment of the invention will now be described with reference top the accompanying drawings in which:

FIG. 1 is a perspective view of the front face of an information storage and retrieval device according to the present invention with the slider panel portion partly withdrawn following the destruction of frangible connection means provided at the time of manufacture to retain the slider panel within the housing sleeve, FIG. 2 is a perspective view of the back face of the device of FIG. 1 with the slider panel portion fully housed in the sleeve, FIG. 3 is a plan view of a blank from which the device can be formed, FIG. 4 is a perspective view of an embodiment of the device of the invention where the slider is of a multi-panel type, FIG. 5 is an edge view showing the slider panels folded in concertina fashion for enclosing in the sleeve of the device, FIG. 6 is an end view of a partially folded further embodiment of the invention and FIG. 7 is a perspective view of the embodiment shown in FIG. 6 with a cover panel for the apertured panel slightly open.

The device is made from a sheet of cardboard or like material capable of folding and gluing but with sufficient stiffness to maintain its form and withstand repeated handling.

From FIG. 3 it will be seen the blank 2 for the device 1 comprises a plurality of edge to edge connected rectangular panel portions identified 3,4,5 and 6. The panel portion 3 is a front panel portion with two long edges 7 and 8 respectively connected by fold lines 9 and 10 to one long edge 11 of the narrow panel portion 4 which is a glue panel and to a first long edge 12 of a sleeve back panel portion 5. The panel 5 has a second long edge 13 connected by frangible connection means to a connection edge 14 of a slider panel portion 6 carrying printed matter, represented schematically in FIGS. 1 and 3 and identified 19.

The frangible connection means comprises sections 15 of the cardboard sheet between the adjacent ends of cuts 16 in a line of cuts extending in the length direction of the panel portions.

There is a viewing aperture 17 in the front panel portion 3 extending substantially the whole width thereof. There is a finger grip notch 18 in the end edge of the panel portions 3 and 5 to allow the slider panel portion 6 to be gripped when the device is fabricated into the FIG. 1 form.

All of the above initial manufacturing steps including the printing of information on the slider panel (and the outer surfaces of the front and back panel portions if desired) can be done mechanically in known printing and cardboard handling machines. It will be understood that the above blank can be one of a number in a sheet of blanks fabricated in a conventional cutting and creasing operation as known in the cardboard industry. Such operation would involve blank forming, creasing and perforation on a forming plate of known type as a preliminary to collating the blanks and feeding them to a folding and glueing machine.

In fabrication of the blank into the device of fig.1 the folding machine would form a fold along said frangible connection means to place said slider panel portion 6 in overlying relationship with an inner face of said back panel portion 5 followed by forming a fold along the fold line between said front panel portion 3 and said back panel portion 5 to place them in an overlying relationship with said slider panel portion 6 sandwiched therebetween. A fold is then formed along the fold line between said front panel portion 3 and said glue panel portion 4 to place the glue panel portion 4 in an overlying relationship with part of an outer face of said back panel portion 5 to which it is glued.

The device would be supplied in the FIG. 2 form with the frangible connecting means intact and the user on the first application of force to move the slider panel portion in an information retrieval operation would rupture the frangible connecting means thereby rendering the device serviceable and as represented in FIG. 1.

Any references herein to front and back panels for the device is not to be taken as a limitation on the manner in which the device is to be used. It will be understood that the aperture 17 can be in either a front or back panel of the device or may be provided in beth allowing information printed on beth sides of the panel 13 to be read. It is further to be understood that multiple apertures may be provided in one or both of the panels which would normally be considered as the front or back face for the device.

Whilst rectangular panels have been described in the specification it is to be understood that the panels may be of "square shape" rather than of rectangular shape where the panels would be provided with long sides and shorter ends.

Referring now to FIG. 4, the slider panel 6 has two extra panels 20 and 21 connected edge to edge by fold/hinge lines 22 and 23. In a manufacturing operation the panels 6,20 and 21 would be folded concertina fashion, as shown in FIG. 5, before being enclosed in the sleeve of panels 3 and 5. Once the slider is separated from the sleeve the slider can be removed from the sleeve and the slider panels can be arranged by folding as desired so that the required information slider panel is viewable through the aperture 17. There can be more than two extra panels. if desired.

Referring now to FIG. 6, this is an end view which illustrates a folding sequence of an embodiment of the invention which provides a cover for the apertured panel 3. The arrangement includes an enlarged glue panel 4a connected through a fold line 24 to a cover panel 25. In the diagrammatic illustration that is FIG. 6 glue lines 26 are shown, these secure the glue panel 4*a* to the external face of the panel 5. As will be understood the finished product will be as shown in FIG. 7.

We claim:

1. An information retrieval device fabricated from one piece of stiff sheet material, said information retrieval device comprising:

a circumferentially closed sleeve open at both ends and housing a captive information bearing slider panel;

a plurality of edge to edge connected panels providing a sleeve front panel with two join edges respectively joined by fold lines to one join edge of a connecting panel narrower than said front panel and to a first join edge of a sleeve back panel, with a second join edge on the sleeve back panel;

frangible connection means comprising sections of said material between cuts through said material connecting a connection edge of the slider panel to the second join edge of the sleeve back panel;

a fold along said frangible connection means placing said slider panel in an overlying relationship with an inner face of said sleeve back panel;

a fold along the fold line between said front panel and said back panel placing the front panel and the sleeve back panel in an overlying relationship with the slider panel sandwiched therebetween; and, a fold along the fold line between said front panel and said connecting panel placing the connecting panel in an overlying relationship with part of an outer face of a sleeve back panel portion to which it is fixed, the frangible connection means being breakable by force applied to the slider panel to slide the slider panel within the sleeve, and at least one aperture in the sleeve for providing viewing access to the slider panel.

2. An information retrieval device fabricated from one piece of stiff sheet material, said information retrieval device comprising:

a circumferentially closed sleeve open at both ends and housing a captive information bearing slider panel assembly;

a plurality of edge to edge connected panels which provide a sleeve front panel, a sleeve back panel substantially the same width between edges as the sleeve front panel, a connection panel and a plurality of slider panels;

folds along fold lines at edge connections of the slider panels for placing said slider panels in an overlying relationship as an assembly having a width less than the width of said sleeve back panel, said front panel having two join edges respectively joined by fold lines to one join edge of the connecting panel which is narrower than said front panel, with a second join edge on the sleeve back panel;

frangible connection means comprising sections of said material between cuts through said material connecting a connection edge of a first of said slider panels to the second join edge of the sleeve back panel;

a fold along said frangible connection means placing said slider panel assembly in an overlying relationship with an inner face of said sleeve back panel;

a fold along the fold line between said front panel and said sleeve back panel placing the front panel and the sleeve back panel in an overlying relationship with the slider panel assembly sandwiched therebetween; and, a fold along the fold line between said front panel and the connecting panel placing the connecting panel in an overlying relationship with part of an outer face of a sleeve back panel portion to which it is fixed, the frangible connection means being breakable by force applied to the slider panel assembly for sliding the slider panel within the sleeve, and at least one aperture in the sleeve for providing viewing access to the slider panel assembly.

3. An information retrieval device, comprising:

a plurality of edge to edge connected panels of a sheet of stiff material, said edge connected panels including a sleeve front panel with two join edges respectively joined by fold lines to one join edge of a glue panel and to a first join edge of a sleeve back panel, a second join edge on the sleeve back panel being connected by connection means to a connection edge of an information bearing slider panel, wherein a fold is provided along said connection means for placing said slider panel in an overlying relationship with an inner face of said sleeve back panel, and with a fold along the fold line between said front panel and said sleeve back panel for placing them in an overlying relationship with said slider panel disposed between said front panel and said sleeve back panel, with a fold being provided along the fold line between said front panel and said one join edge of the glue panel for placing said glue panel in an overlying relationship with an outer face of said sleeve back panel to which it is glued for forming a sleeve open at two ends, at least one aperture in the sleeve for giving viewing access to information on the slider panel, said glue panel having a second edge opposite its first edge connected by a cover fold line to a first edge of a cover panel, which when folded on said cover fold line so as to embrace the first join edge of the sleeve back panel, will overlie said front panel of said sleeve, said connection means comprising portions of said sheet material between cuts through said material making said connection means breakable by a force applied to said slider panel for sliding the slider panel within said sleeve.

4. A method for making an information retrieval device having an open-ended circumferentially-closed sleeve with at least one aperture in said sleeve for giving viewing access to an information bearing slider panel portion mounted in the sleeve and retained therein by frangible connection means, said connection means being breakable by a force applied to said slider panel portion for sliding the slider panel portion within said sleeve, said method comprising the steps of:

providing a sheet of stiff material;

forming parallel fold lines along said sheet for providing a front panel portion disposed between a back panel portion of substantially the same width as the front panel portion and a narrower glue panel portion and a further parallel fold line along said sheet which is perforated for providing a frangible connection means between said back panel portion and a slider panel portion;

providing at least one viewing aperture in at least one of the front panel portion and the back panel portion;

forming a fold along said fold line which is perforated for placing said slider panel portion in an overlying relationship with an inner face of said back panel portion;

forming a fold along the fold line between said front panel portion and said back panel portion for placing the front panel portion and the back panel portion in an overlying relationship with said slider panel portion being sandwiched therebetween;

forming a fold along the fold line between said front panel portion and said narrower glue panel portion for placing said glue panel portion in an overlying relationship with part of an outer face of said back panel portion; and, gluing said narrower glue panel portion to said back panel portion.

5. The method as claimed in claim 4, further comprising the step of providing a finger grip notch in corresponding ends of each of the front panel portion, the back panel portion and the glue panel portion for allowing the slider panel to be gripped for the application of force for breaking said frangible connection means and for moving the slider panel when separated from the back panel portion within said sleeve.

6. A method for making an information retrieval device having an open-ended circumferentially-closed sleeve with at least one aperture in said sleeve for giving viewing access to an information bearing slider panel assembly mounted in said sleeve and retained therein by frangible connection means, said connection means being breakable by a force applied to said slider panel assembly for sliding the slider panel within said sleeve, said method comprising the steps of:

providing a sheet of stiff material;

forming parallel fold lines along said sheet for providing a front panel portion disposed between a back panel portion of substantially the same width as the front panel portion and a narrower glue panel portion and a further parallel fold line along said sheet, which is perforated for providing a frangible connection means between said back panel portion and a first of several slider panels joined to one to another by parallel fold lines;

providing at least one viewing aperture in at least one of the front panel portion and the back panel portion;

forming a fold along the fold line which is perforated for placing slider panels when folded one over the other for forming an assembly in an overlying relationship with an inner face of said back panel portion;

forming a fold along the fold line between said front panel portion and said back panel portion for placing the front panel portion and the back panel portion in an overlying relationship with said slider panel assembly being sandwiched therebetween; and, forming a fold along the fold line between said front panel portion and said glue panel portion for placing said glue panel portion in an overlying relationship with part of an outer face of said back panel portion and gluing said glue panel portion to said back panel portion.

7. A method for making an information retrieval device having an open-ended circumferentially-closed sleeve with at least one aperture in said sleeve for giving viewing access to an information bearing slider panel portion mounted in the sleeve and retained therein by frangible connection means, said connection means being breakable by a force applied to said slider panel portion for sliding said slider panel portion within said sleeve, said method comprising the steps of:

providing a sheet of stiff material;

forming parallel fold lines along said sheet for providing a series of edge connected panels consecutively comprising a cover panel, a glue panel, a sleeve front panel, a sleeve back panel and a slider panel with a fold line between said sleeve back panel and said slider panel perforated for providing a frangible connection means between said sleeve back panel and said slider panel;

providing at least one viewing aperture in said sleeve front panel;

forming a fold along said fold line which is perforated for placing said slider panel portion in an overlying relationship with an inner face of said back panel portion;

forming a fold along the fold line between said front panel portion and said back panel portion for placing the front panel portion and the back panel portion in an overlying relationship with said slider panel portion being sandwiched therebetween;

forming a fold along the fold line between said front panel portion and said glue panel portion for placing said glue panel portion in an overlying relationship with an outer face of said back panel portion and gluing said glue panel portion to said back panel portion; and, folding said cover panel portion around the fold line between said sleeve front panel portion and said back panel portion for embracing it to position said cover panel portion in an overlying relationship with said sleeve front panel portion.

8. The method as claimed in claim 7, further comprising the step of providing a finger grip notch in corresponding ends of each of the front panel portion, the back panel portion and the glue panel portion for allowing the slider panel to be gripped for the application of force for breaking said frangible connection means and for moving the slider panel when separated from the back panel portion within said sleeve.

* * * * *